US007942184B2

(12) United States Patent
Cech et al.

(10) Patent No.: US 7,942,184 B2
(45) Date of Patent: May 17, 2011

(54) VERTICAL CELLULAR BLIND

(75) Inventors: Michael John Cech, Cross Plains, WI (US); Toralf H. Strand, Exeter, NH (US); Dag Hammarskjold Cecchetti, Madison, WI (US); Nicholas James Schultz, Marshall, WI (US)

(73) Assignee: Springs Window Fashions, LLC, Middleton, WI (US)

( * ) Notice: Subject to any disclaimer, the term of this patent is extended or adjusted under 35 U.S.C. 154(b) by 259 days.

(21) Appl. No.: 11/942,427

(22) Filed: Nov. 19, 2007

(65) Prior Publication Data

US 2008/0115894 A1 May 22, 2008

Related U.S. Application Data

(60) Provisional application No. 60/866,507, filed on Nov. 20, 2006.

(51) Int. Cl.
*A47H 5/00* (2006.01)

(52) U.S. Cl. ..... 160/84.05; 160/84.06; 160/172 V

(58) Field of Classification Search ..... 160/168.1 V, 160/167.1 V, 172 V, 173 V, 178.1 V, 178.2, 160/84.06, 84.05, 199; 16/87.4 R, 95 D; 24/292

See application file for complete search history.

(56) References Cited

U.S. PATENT DOCUMENTS

| | | | | |
|---|---|---|---|---|
| 2,587,859 A | | 3/1952 | King | 160/172 |
| 2,783,493 A | | 3/1957 | Gussack | 16/97 |
| 2,827,956 A | | 3/1958 | Achler et al. | 160/172 |
| 2,848,045 A | | 8/1958 | Bennett | 160/172 |
| 3,237,238 A | | 3/1966 | Anderson | 16/105 |
| 3,280,891 A | | 10/1966 | Eldredge et al. | 160/172 |
| 3,286,299 A | | 11/1966 | Golden | 16/87.4 |
| 3,298,425 A | | 1/1967 | Cayton et al. | 160/176 |
| 3,516,215 A | | 6/1970 | Smith et al. | 52/656 |
| 3,619,947 A | | 11/1971 | Burum | 49/425 |
| 3,626,429 A | | 12/1971 | Toder | 16/87.2 |
| 3,716,890 A | | 2/1973 | Benson | 16/91 |
| 3,719,221 A | | 3/1973 | Hanson | 160/168 |
| 3,921,694 A | | 11/1975 | Galex | 160/166 A |
| 4,006,513 A | | 2/1977 | Offterdinger | 16/99 |
| 4,030,160 A | | 6/1977 | Lambertz et al. | 16/105 |
| 4,103,727 A | | 8/1978 | Spohr | 160/168 R |
| 4,189,870 A | | 2/1980 | Helmick | 49/420 |
| 4,193,438 A | | 3/1980 | Pastore | 160/166 A |
| 4,352,384 A | | 10/1982 | McCoy, Jr. | 160/172 |
| 4,355,677 A | * | 10/1982 | Madsen | 160/126 |
| 4,675,939 A | * | 6/1987 | Fukada | 16/87.2 |

(Continued)

FOREIGN PATENT DOCUMENTS

| | | |
|---|---|---|
| CA | 2111918 | 6/1995 |

(Continued)

*Primary Examiner* — Blair M. Johnson
(74) *Attorney, Agent, or Firm* — Taylor IP

(57) ABSTRACT

A vertical cellular blind includes a headrail having first and second tracks; a fabric carriage including a trolley translatable along one of the tracks and a fabric stem releasable connected to the trolley; a cellular fabric panel connected to the fabric stem; a vertical rail bracket translatable along the other of the tracks in the headrail and including a component angularly adjustable relative to the headrail; a vertical rail attached to the panel and connected to the vertical rail bracket; a cord having ends secured in the headrail and extending through the panel and the vertical rail; and a locking handle in the vertical rail having the cord extended therethrough and releasable pinching means in the handle for engaging the cord.

4 Claims, 10 Drawing Sheets

U.S. PATENT DOCUMENTS

| | | | | | |
|---|---|---|---|---|---|
| 4,811,466 | A | * | 3/1989 | Zubli | 24/115 G |
| 4,862,941 | A | * | 9/1989 | Colson | 160/84.02 |
| 4,869,309 | A | | 9/1989 | Evans | 160/177 |
| 4,873,741 | A | | 10/1989 | Riegelman | 16/105 |
| 4,915,153 | A | * | 4/1990 | Toti | 160/84.04 |
| 4,917,167 | A | | 4/1990 | Voss et al. | 160/84.1 |
| 4,964,191 | A | | 10/1990 | Wyatt | 16/87.2 |
| 4,967,823 | A | | 11/1990 | Gagnon | 160/177 |
| 5,035,025 | A | | 7/1991 | Morris et al. | 16/97 |
| 5,119,872 | A | | 6/1992 | Engebretson | 160/381 |
| 5,275,222 | A | | 1/1994 | Jelic et al. | 160/178.2 |
| 5,289,863 | A | | 3/1994 | Schön | 160/168.1 |
| 5,351,737 | A | * | 10/1994 | Hoshiyama | 160/84.03 |
| 5,450,889 | A | | 9/1995 | Jones et al. | 160/38 |
| 5,465,779 | A | * | 11/1995 | Rozon | 160/168.1 V |
| 5,595,232 | A | | 1/1997 | Benthin | 160/178.1 |
| 5,676,188 | A | | 10/1997 | Cadorette | 160/178.1 V |
| 5,924,467 | A | | 7/1999 | Allsopp | 160/177 V |
| 5,927,367 | A | * | 7/1999 | Toti | 160/173 V |
| 6,000,456 | A | | 12/1999 | Neverett | 160/178.1 V |
| 6,050,321 | A | | 4/2000 | Koks et al. | 160/178.2 R |
| 6,085,824 | A | | 7/2000 | Cadorette | 160/177 V |
| 6,105,656 | A | | 8/2000 | Hernandez et al. | 160/168.1 V |
| 6,131,243 | A | * | 10/2000 | Lee | 16/87.2 |
| 6,196,293 | B1 | | 3/2001 | Lee | 160/168.1 |
| 6,289,563 | B1 | * | 9/2001 | Watkins | 29/24.5 |
| 6,321,413 | B1 | | 11/2001 | Zingg | 16/105 |
| 6,330,900 | B1 | | 12/2001 | Welfonder | 160/178.1 V |
| 6,334,477 | B1 | | 1/2002 | Moir | 160/168.1 V |
| 6,360,806 | B1 | | 3/2002 | Bowman et al. | 160/168.1 V |
| 6,412,538 | B1 | | 7/2002 | Welfonder | 160/271 |
| 6,450,234 | B2 | | 9/2002 | Welfonder | 160/178.1 V |
| 6,457,509 | B1 | | 10/2002 | Anderson et al. | 160/178.1 V |
| 6,618,900 | B2 | | 9/2003 | Spork et al. | 16/87 R |
| 6,766,847 | B1 | * | 7/2004 | Wang | 160/199 |
| 6,813,862 | B2 | | 11/2004 | Perich et al. | 49/425 |
| 6,957,682 | B2 | | 10/2005 | Huang et al. | 160/168.1 V |
| 2001/0011583 | A1 | | 8/2001 | Spork | 160/199 |
| 2004/0123959 | A1 | | 7/2004 | Toti | 160/199 |
| 2005/0230061 | A1 | | 10/2005 | Wilkins | 160/172 |
| 2006/0151131 | A1 | | 7/2006 | Bohlen et al. | 160/177 |
| 2008/0115894 | A1 | * | 5/2008 | Cech et al. | 160/168.1 V |

FOREIGN PATENT DOCUMENTS

| | | |
|---|---|---|
| CH | 645423 | 9/1984 |
| JP | 06063797 | 9/1994 |
| JP | 10046960 | 2/1998 |
| JP | 2004218331 | 8/2004 |

* cited by examiner

VERTICAL CELLULAR BLIND

CROSS REFERENCE TO RELATED APPLICATIONS

This is a non-provisional application based upon U.S. provisional patent application Ser. No. 60/866,507, entitled "VERTICAL CELLULAR BLIND", filed Nov. 20, 2006, which is incorporated herein by reference.

BACKGROUND OF THE INVENTION

1. Field of the Invention

The present invention relates generally to window and patio door coverings or blinds, and, more particularly to coverings or blinds using vertical cellular fabrics.

2. Description of the Related Art

Vertical cellular blinds are known. Known vertical cellular blinds for patio doors, large windows and the like have a fixed vertical rail at one end and a movable vertical rail at the other end. It also is known to provide movable vertical rails at both ends of the blind. Cellular fabric is positioned between and connected to each vertical rail. Fabric-holding carriages are connected to the cellular fabric, and end carriages are connected to the movable vertical rail or rails. The carriages are suspended from a headrail, which also holds the fixed vertical rail if one is provided in place of one of the movable vertical rails. The movable vertical rail or rails can be adjusted in position relative to the overall length of the headrail between a fully closed position with the vertical rails positioned at the extreme opposite ends of the headrail and the fabric stretched there between, and a fully opened position with the fabric bunched tightly between the rails at one end or the other of the headrail. The movable vertical rail or rails can be positioned at any location between the maximum opened position and the maximum closed position so that a desirable area of the window or patio door there behind can be exposed.

It is known to use a cord or tape secured in the headrail and routed through the vertical rails and the fabric to provide stability to the fabric, and to promote straight orientation substantially parallel to the wall or patio door behind it. Due to the natural "springiness" of the cellular material, the blind may "creep" or move on its own from the position to which it is adjusted. The size of the blind and the characteristics of the fabric from which it is made affect the springiness and tendency for creep in the completed blind. For example, some relatively stiffer materials are used to improve light blocking, and the stiffer materials are springier than lighter materials used when light filtering is the desired effect. To overcome creep, frictional resistance is designed into the relative movement between the tape and fabric and/or between the tape and movable vertical rail to keep the blind in the desired adjusted position. However, excessive friction between the cord or tape and the fabric or movable vertical rail can make the blind difficult to traverse along the headrail between closed and opened positions. Additional force from the user is required to overcome the friction inhibiting relative movement between the blind structures and the tape or cord. It is known to provide user operable adjustments in the mechanisms establishing frictional resistance to relative movement between the tape and the blind structures. However, these can be difficult to adjust properly. Often, the blind is adjusted so that it is easy to operate but then suffers from creep. Alternatively, the mechanism can be adjusted to ensure that creep is inhibited by adjusting in a relatively high level of friction; however, the blind then can be difficult to operate.

Another inconvenience in known vertical cellular blinds is that the springiness of the cellular fabric can exert uneven forces against the vertical rails, particularly the movable vertical rail if one vertical rail is movable and the other is fixed. This can cause the vertical rail to hang from the headrail at an angle, in a non-true vertical position. An undesirable appearance can result.

Yet another inconvenience in known vertical cellular blinds is that some fabrics used therefor flex or create a wavy appearance when closed. Generally, the longer the shade, the more the wavy appearance that is created.

Still other inconveniences of known vertical cellular blinds are associated with the operation of the carriages and track assembly in the headrail. Carriages operating on the same track abut one against another even before the cellular fabric is fully compressed. Accordingly, the blind cannot be stacked or bunched as tightly as the fabric material would allow, because the carriages require more space for stacking than is required by the fabric suspended from the carriages. If carriages carrying the vertical rails are larger than the fabric panel carriages, the appearance of the closed blind is inconsistent, in that the center will bunch more tightly than the ends. Still further, it is known to connect the cellular fabric material relatively rigidly to the substantially rigid carriages. If the cellular fabric is accidentally pulled or tugged, the material can tear at the connections to the carriages from which it is suspended. Repair can be difficult and sometime unsightly.

SUMMARY OF THE INVENTION

The present invention addresses these and other difficulties and disadvantages of known vertical cellular blinds by providing a cord or multiple cords routed through the cellular fabric and through the movable vertical rails at both ends of the blind. Each vertical rail includes a locking handle designed to capture and grasp one of the cords that is routed therethrough, to prevent creep. Trigger mechanisms in the handles release the cord so that the cord slides easily relative to the handle and the blind can be adjusted easily. Cord guides in the vertical rails promote smooth operation during opening and closing of the blind. Carriages for the cellular material have a breakaway feature so that accidental pulling on the fabric merely disconnects two re-connectable portions of the carriage before damage occurs to the fabric. Vertical rail carriages are adjustable angularly, so that the vertical rails are suspended vertically there from even when the springiness of the cellular material provides consistent lateral forces there against. Multiple tracks are provided so that carriages for the vertical rails operate on one track with the carriages for the fabric bunched thereunder on a lower track when the blind is fully opened.

In one aspect of one form thereof, the present invention provides a vertical cellular blind for an architectural opening with a headrail having first and second tracks therein at different elevations; a panel of cellular material suspended from carriages moveable in one of the tracks; a vertical rail at an end of the panel, the vertical rail being connected to the panel and being movable along the other of the tracks; and a cord extending through the fabric panel and into the vertical rail and having a segment extending out of the vertical rail and secured in the headrail.

In another aspect of another form thereof, the present invention provides a fabric panel carriage for a vertical cellular blind having a headrail and a cellular fabric panel. The fabric panel carriage has a stem connected to the panel; a trolley suspended from the headrail; wheels on the trolley received in and moveable along a track in the headrail and a releasable connection between the stem and the trolley accommodating and maintaining relative rotation between the stem and the trolley.

In still another aspect of still another form thereof, the present invention provides a vertical cellular blind for an architectural opening with a headrail; a panel of cellular material suspended from carriages moveable in the headrail; a vertical rail at an end of the panel, the vertical rail being connected to the panel and being movable along the headrail. A first cord extends through the fabric panel at a first distance from the headrail, the first cord extending from the panel into the vertical rail and having a segment extending out of the vertical rail and secured in the headrail. A second cord extends through the fabric panel at a second distance from the headrail different from the first distance, the second cord extending from the panel into the vertical rail and having a segment extending out of the vertical rail and secured in the headrail.

In a further aspect of a further form thereof, the present invention provides a locking handle for a vertical cellular blind having a headrail, a panel of cellular material suspended from the headrail, a vertical rail at one end of the panel, and a cord secured in the head rail and extending through the panel and into the vertical rail. The locking handle has a lock body secured in the vertical rail; a trigger component pivotally connected to the lock body; a first opening defined in the lock body; and a second opening defined in the trigger component. The first and second openings receive the cord therein. The lock body and the trigger component are biased relative to one another to define a restricted registered alignment between the openings for pinching the cord between the lock body and the trigger component.

In a still further aspect of a still further form thereof, the present invention provides a cord guide for a vertical cellular blind having a headrail, a panel of cellular material suspended from the headrail, a vertical rail at an end of the panel, the vertical rail and at least a portion of the panel being translatable along the headrail, and a cord secured in the head rail and extending through the panel and into the vertical rail. The cord guide includes a guide body secured in the vertical rail; and a curved guide surface on the body receiving and redirecting the cord between substantially horizontal and vertical paths. The guide surface extends from a periphery of the vertical rail to a substantially inward position in the vertical rail.

An advantage of the present invention in one form thereof is providing a vertical cellular blind that minimizes creep, even in long lengths of the blind and in blinds of different widths.

Another advantage of the present invention in another form thereof is providing a vertical cellular blind having adjustable vertical rails so that the vertical rails can be positioned in desired vertical positions.

Still another advantage of still another form of the present invention is providing releasable carriages that minimize fabric damage if the fabric is inadvertently pulled away from the headrail.

Yet another advantage of the present invention in yet another form thereof is providing a vertical cellular blind that stacks compactly at either end of the blind to provide maximum exposure of a window or other feature behind the blind.

A further advantage of the present invention a further form thereof is providing a vertical cellular blind that operates smooth between opened and closed positions with reduced cord wear.

A still further advantage of the present invention in a still further form thereof is providing a vertical cellular blind that hangs straight and in line both vertically and horizontally.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
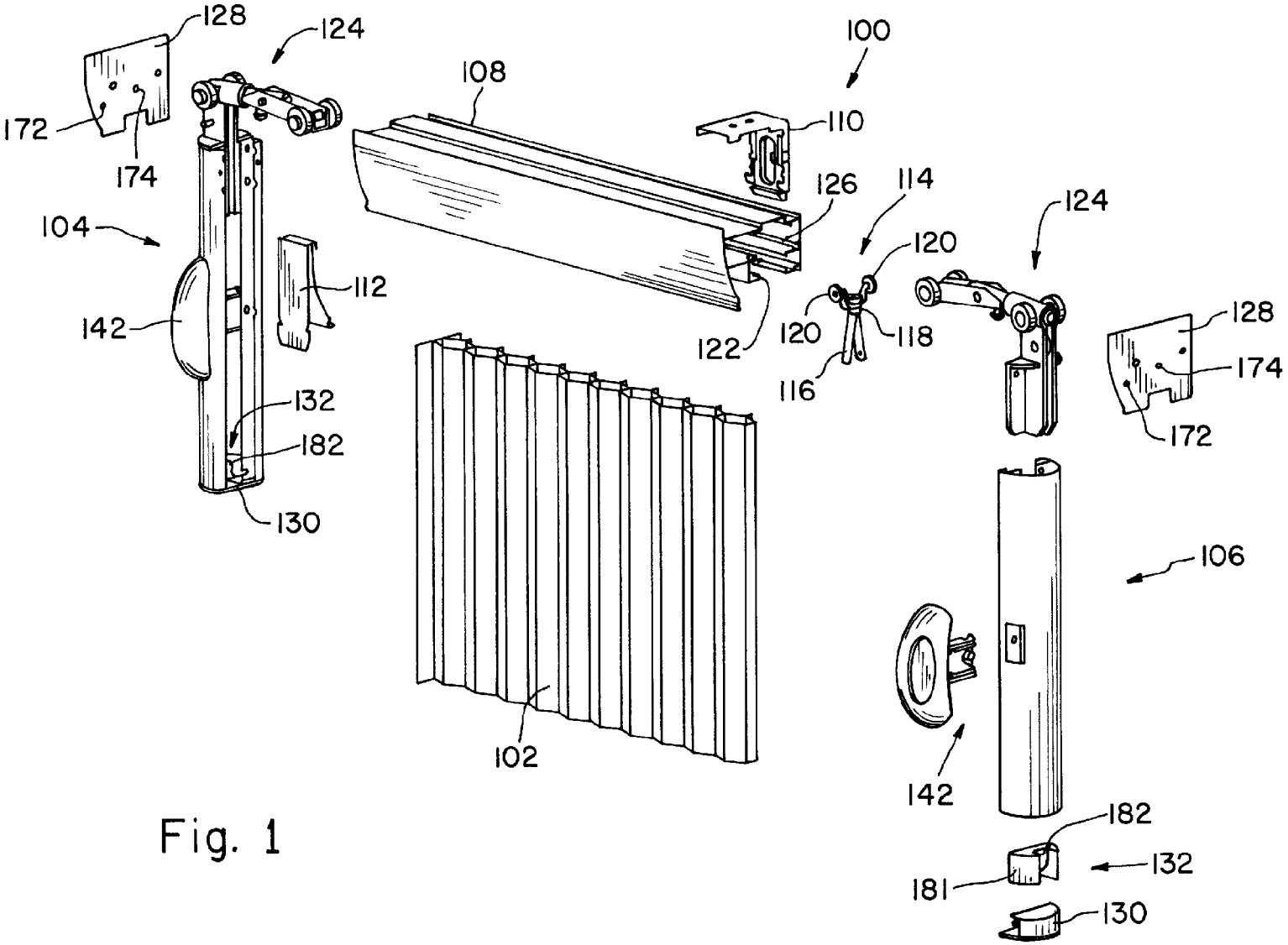
FIG. 1 is an exploded view of a vertical cellular blind in accordance with the present invention.
Figure 2:
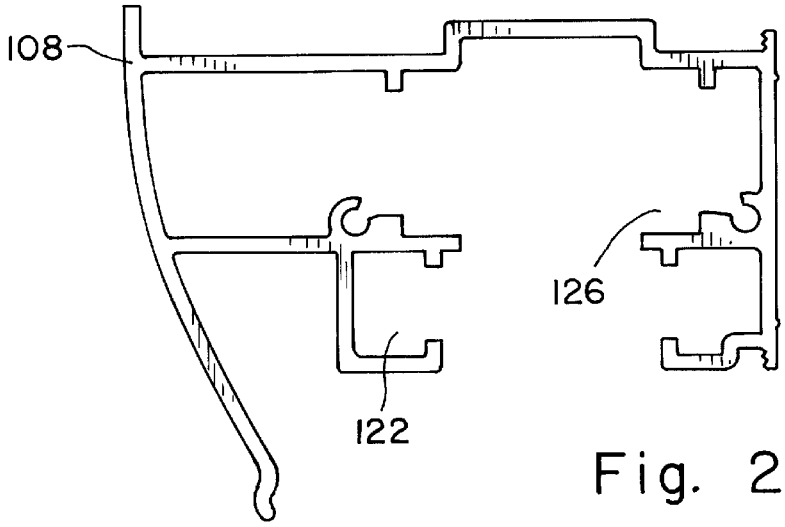
FIG. 2 is an end view of the headrail for the vertical cellular blind shown in FIG. 1.

Referring now more specifically to the drawings and to FIG. 1 in particular, a blind 100 in accordance with the present invention is shown. A cellular fabric panel 102 is used in vertical orientation, that is, each of the cells of the panel is arranged vertically. The end cells of the panel are retained in vertical rails 104, 106. Various types of cellular fabrics are known to those skilled in the art, and can be used in the present invention. It should be understood also that panel 102 need not be a cellular panel within the scope of the present invention, and features of the present invention can be used advantageously for blinds having panels of other types as well.

Vertical cellular blinds are just one example of blinds for which features of the present invention provide particular advantages.

Vertical rails 104, 106 at each end of panel 102, and fabric panel 102 secured between the vertical rails traverse along a headrail 108 at the top of the blind. Headrail 108 is secured in place by several installation brackets 110 attached to a wall or other structure on which blind 100 is installed. Only one such installation bracket 110 is shown in FIG. 1. Valance brackets 112, only one being shown in FIG. 1, are provided for retaining a valance (not shown) on the front of headrail 108. It should be understood that the number of installation brackets 110 and valance brackets 112 will vary, depending on the width of blind 100 from one end of headrail 108 to the other end of headrail 108. For simplicity and clarity in the drawings, only one installation bracket 110 and one valance bracket 112 are shown in FIG. 1.

Cellular fabric panel 102 is held in and suspended from headrail 108 by one or more carriage assembly 114 connected thereto between the connections of fabric panel 102 to vertical rails 104 and 106. Each carriage assembly 114 includes a fabric stem 116 that is connected to fabric panel 102, and a trolley 118 releasably connected to stem 116. Trolley 118 has wheels 120 operatively installed in headrail 108 to traverse along a lower track 122 in headrail 108. Depending on the overall width of fabric panel 102, one or more carriage assembly 114 is used.

Vertical rails 104, 106 are provided on opposite ends of fabric panel 102. Vertical rails 104, 106 are connected to vertical bracket assemblies 124 installed in headrail 108 to traverse along an upper track 126. In the exemplary embodiment shown, each vertical rail 104, 106 is connected to a vertical bracket assembly 124 so that each vertical rail can be moved relative to headrail 108; however, it should be understood that in some installations of a blind in accordance with the present invention it may be desirable that one vertical rail is fixed and only one vertical rail is movable.

End caps 128 are provided on opposite ends of headrail 108 to provide a completed look, and to retain carriage assemblies 114 and vertical bracket assemblies 124 in tracks 122 and 126, respectively. A bottom cap 130 and a cord guide 132 are provided at the lower end of each vertical rail 104, 106.

Figure 3:
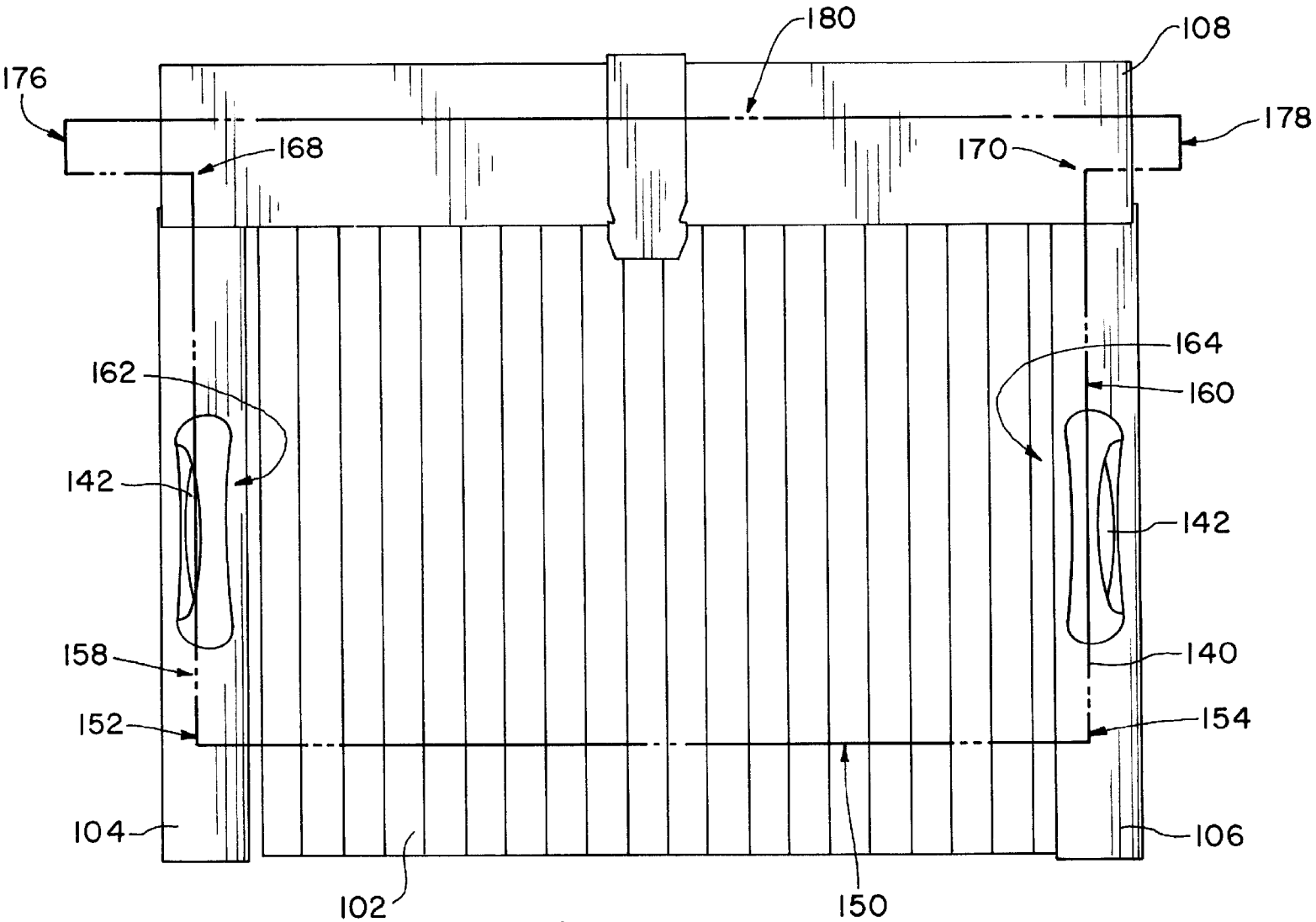
FIG. 3 is a schematic illustration of the cord routing pattern through the vertical cellular blind shown in FIG. 1.
Figure 4:
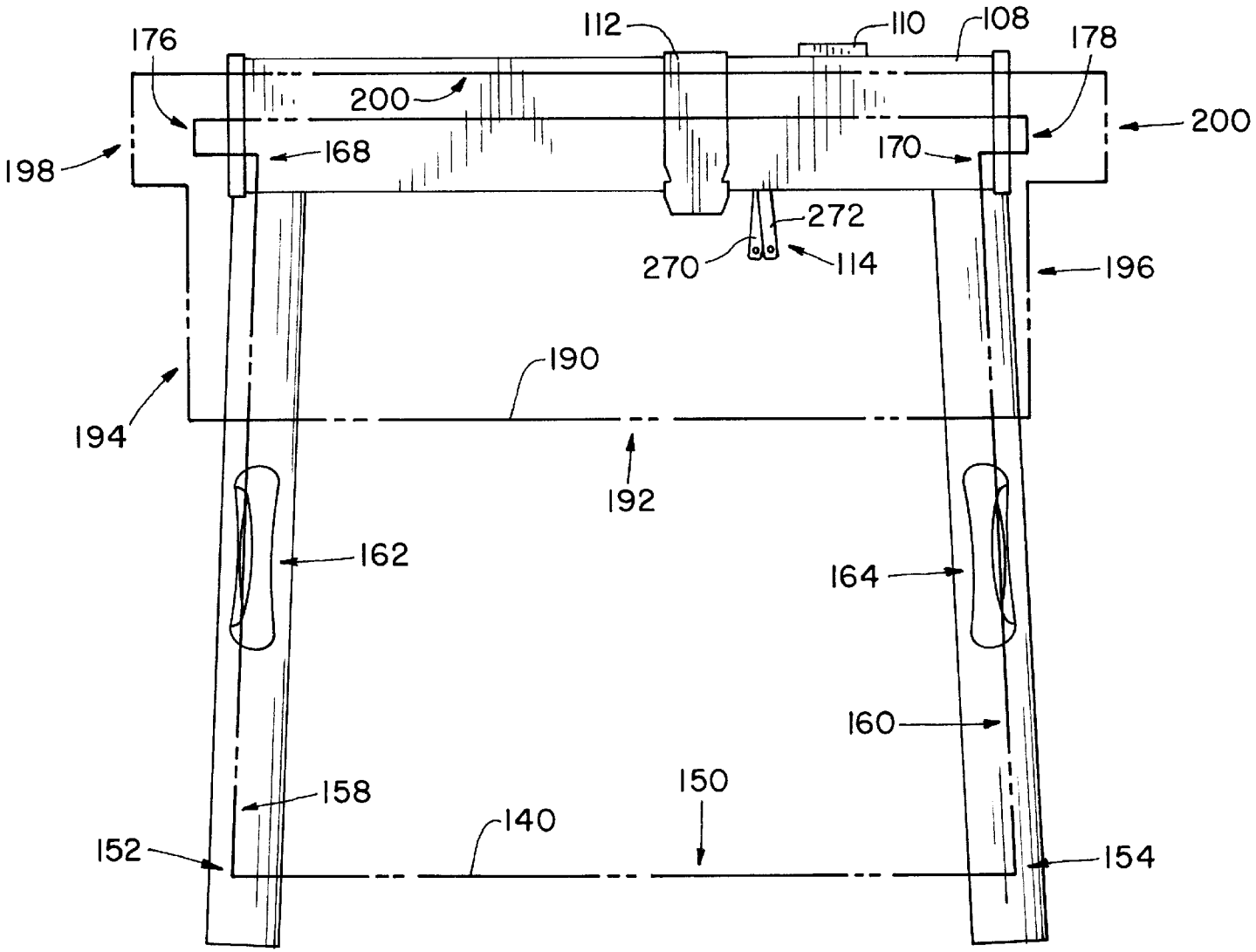
FIG. 4 is a schematic illustration similar to that of FIG. 3, but illustrating a further embodiment having multiple stabilizing cords.

To promote stability and proper linear and vertical disposition of the blind, including proper alignment of fabric panel 102 and vertical rails 104, 106 on opposite sides, a cord 140 extends through the headrail, a substantial portion of the lengths of the vertical rails 104, 106 and into and through the hollow interior portions of the cellular fabric panel 102. A dashed line in FIGS. 3 and 4 represents cord 140 schematically, and the path thereof will be described more fully hereinafter. Cord 140 is maintained relatively taut, and, as routed, if either vertical rail is moved, the cord remains taut, as the linear distance of the cord path does not change. The taut cord 140 reduces billowing of fabric panel 102, so that the fabric panel hangs flat and aligned with vertical rails 104, 106 at opposite sides thereof.

Fabric panel 102 can be stiff and somewhat springy, with the stiffness and springiness differing from one type of panel to another, depending on physical characteristic of the material used, the techniques by which the material is formed into a cellular panel and the like. As a result, when the blind is opened, with the fabric panel compressed tightly between the vertical rails, the panel may tend to expand, urging the blind toward a more closed position. When the blind is closed, with the fabric panel expanded or stretched between the vertical rails positioned near ends of the headrail, the fabric panel may tend to contract, urging the blind toward a more opened position. At various intermediate conditions between fully opened and fully closed conditions, the fabric panel may urge the blind toward more opened or more closed conditions as the panel seeks an equilibrium condition. The result can be a tendency of one or the other vertical rail to creep away from the adjusted position at which it has been placed. A releasable locking handle assembly 142 is provided in each movable vertical rail 104, 106 to reduce the undesirable effects of creep. Locking handle assemblies 142 are configured to capture the cord and prevent creep by inhibiting relative movement between the vertical rail and the cord, unless a lock feature of at least one of the handle assemblies 142 is released to permit such relative movement. The structure and function of locking handle assemblies 142 will be described more fully hereinafter.

With reference now to FIG. 3, the path of cord or 140 is shown, and will be described with respect to designated positions and segments of the path. Cord 140 extends horizontally from cell to cell through holes in the cells of fabric panel 102, along a horizontal segment 150 in the lower portion of fabric panel 102. The cord enters each vertical rail 104, 106 through holes on the fabric-facing sides thereof, and engages a cord guide 132 in each vertical rail 104, 106 at cord guide locations 152, 154. The cord guides 132, to be described in greater detail hereinafter, redirect the cord to extend vertically along vertical cord segments 158, 160 through vertical rails 104, 106, respectively. Along vertical segments 158, 160, cord 140 extends through similar locking handle assemblies 142 at handle positions 162, 164. Vertical segments 158, 160 extend from handle positions 162, 164, respectively, through vertical rail brackets 124 at the top of each vertical rail 104, 106, and around a vertical rail bracket roller 166 (see FIGS. 13 and 14) at roller positions 168 and 170 in FIG. 3. Cord 140 loops through grommets in holes 172, 174 (FIG. 1) of end caps 128 to define external cord segments 176, 178 (FIG. 3) along the outer surfaces of the two end caps 128. Cord 140 extends horizontally through headrail 108 along a path segment 180. Suitable cord tensioning structures (not shown) are provided in headrail 108, as known to those skilled in the art, to maintain a desired degree of tension within cord 140.

Cord guide 132 includes a body 181 that is shaped to fit snuggly in openings in vertical rails 104, 106 at the surfaces adjacent fabric panel 102. A curved guide surface 182 of cord guide 132 defines a path through body 181. In the stalled position of cord guide 132 in a vertical rail 104, 106, guide surface 182 extends from at or near the peripheral surface of the vertical rail adjacent an end of fabric panel 102 into the hollow interior of the vertical rail. Guide surface 182 of each cord guide 132 at cord guide locations 152, 154 provide a gentle transition between horizontal cord segment 150 and vertical cord segments 158, 160 at opposite sides. Accordingly, as either vertical rail 104, 106 is traversed along headrail 108, guide surfaces 182 slide easily along cord 140, which remains in fixed position even as the vertical rails are moved.

Figure 5:
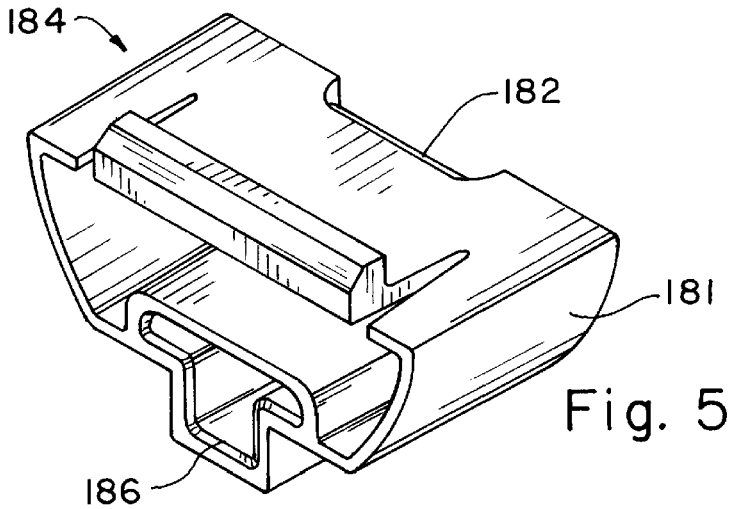
FIG. 5 is a perspective view of a cord guide used in the vertical blind of the previous drawings.
Figure 6:
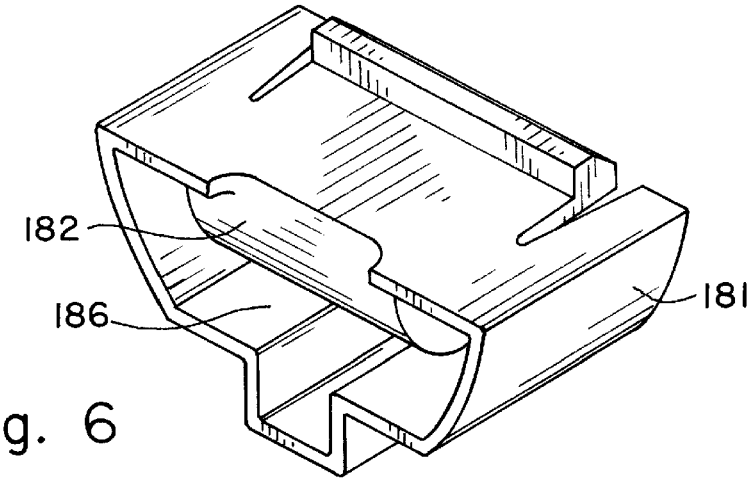
FIG. 6 is a perspective view of the cord guide similar to that of FIG. 5, but illustrating the side opposite the side shown in FIG. 5.
Figure 7:
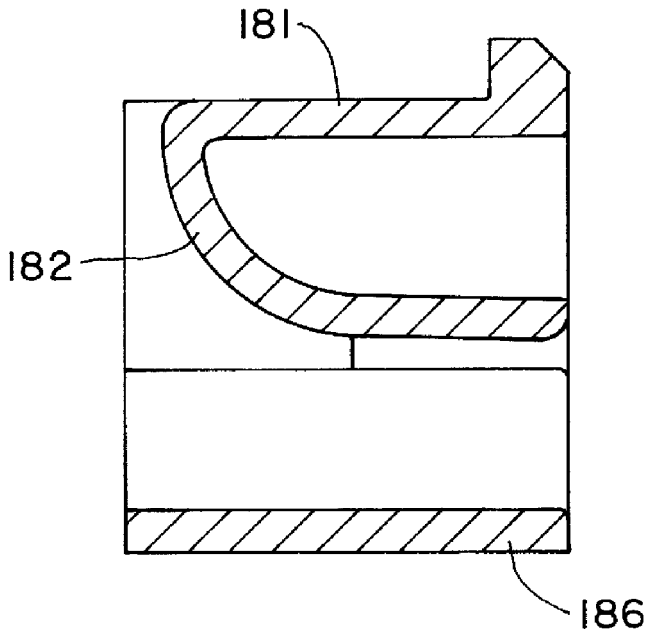
FIG. 7 is a cross-sectional view through the cord guide shown in FIG. 6, the cross-section having been taken along line 7-7 of FIG. 6.

FIGS. 5, 6 and 7 illustrate yet another cord guide 184 similar to cord guide 132, but having the addition of a channel piece 186 through which cord 140 extends. Channel piece 186 is integral with body 181 and extends over and in spaced relationship to guide surface 182. Otherwise, cord guide 184 includes body 181 and guide surface 182, which are the same as cord guide 132.

Cord guides 132, 184 facilitate smooth operation of the blind and reduce wear on the cord. The cord guides direct the cord to the center or other selected area in the vertical rails to initiate a desired path in the vertical rails. Further, cord guides 132, 184 align the cord as desired with locking handle assemblies 142, which will be described in greater detail hereinafter.

In some situations, such as for blinds of significant width and/or length, it may be desirable to provide additional cords for positioning fabric panel 102 and vertical rails 104, 106. To inhibit billowing of fabric panel 102 in wide or tall blinds, one or more secondary guide cord 190 (FIG. 4) can be used. Secondary guide cord 190 is generally routed similarly to cord 140, but at a different elevational position through fabric panel 102, and without passing through handle assemblies 142, as engagement for locking against guide cord 140 is sufficient to prevent creep. Secondary guide cord 190 can simply bypass handle positions 162, 164; or the secondary guide cord can be positioned within fabric panel 102 to enter vertical rails 104, 106 between headrail 108 and handle positions 162, 164. Secondary guide cord 190 includes a horizontal segment 192 through the fabric panel at an elevation different from the elevation of horizontal segment 150 for cord 140. Vertical segments 194, 196 are provided along vertical rails 104, 106 respectively and looped external segments 198, 200 are provided on the outer surfaces of the two end caps 128 at opposite ends of headrail 108. A horizontal headrail segment 202 completes the path of secondary guide cord 190. Again, suitable tensioning equipment (not shown) can be provided in headrail 108. It should be further understood that a third or more secondary guide cord can be used for particularly large blinds.

Figure 8:
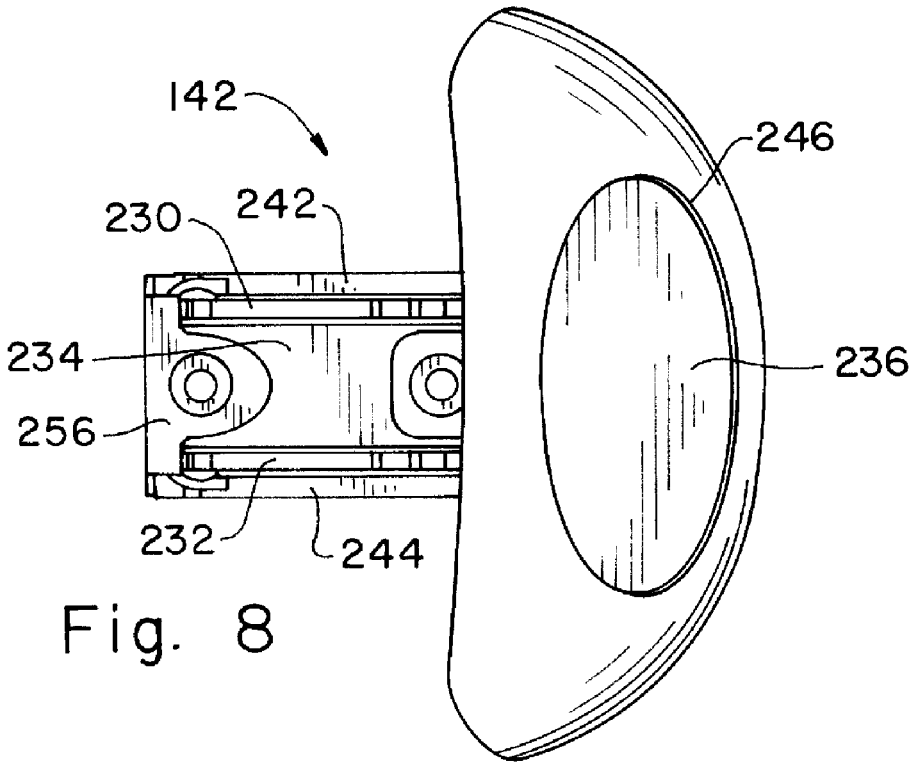
FIG. 8 is a top view of a handle assembly for the vertical cellular blind shown in FIG. 1.
Figure 9:
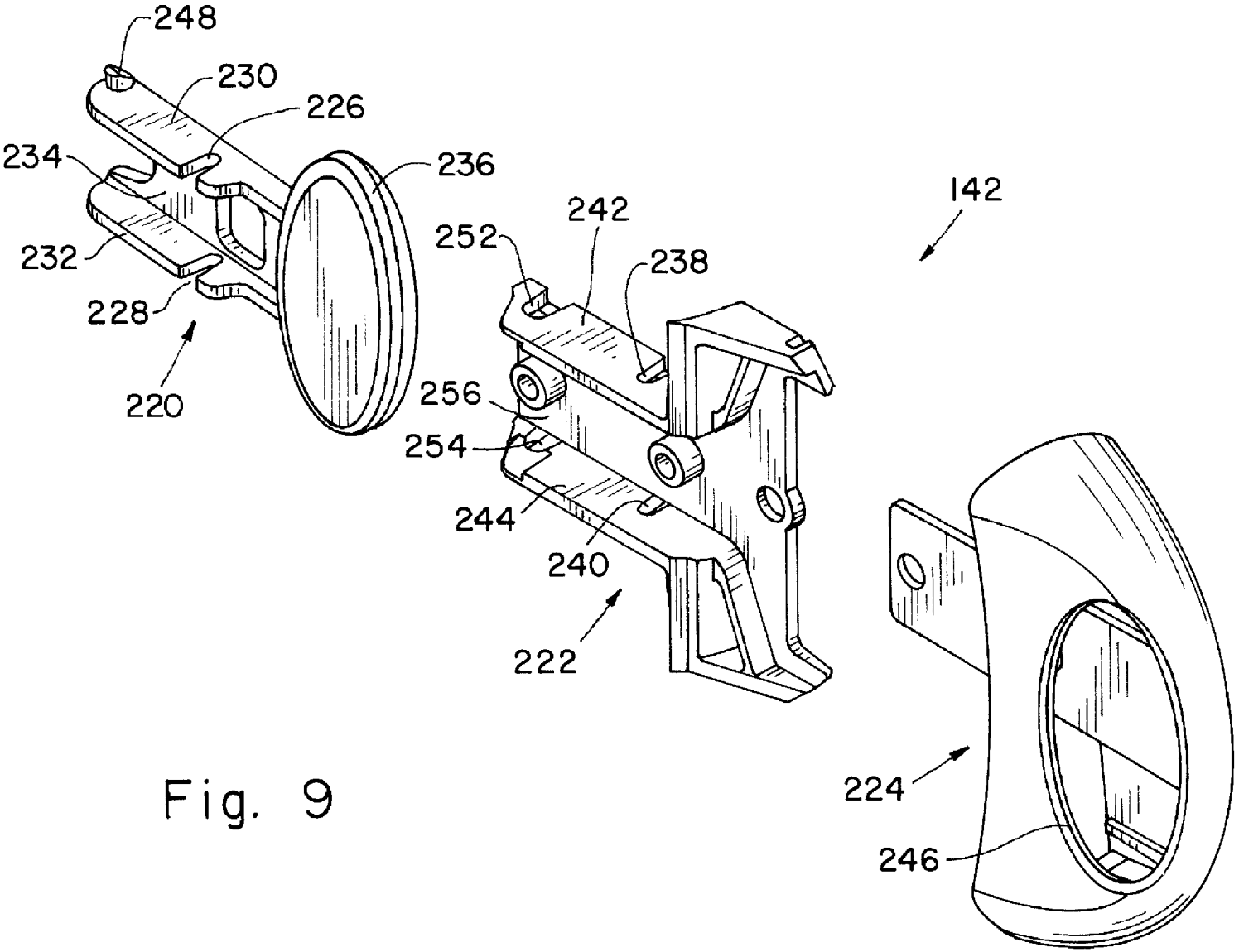
FIG. 9 is an exploded perspective view of the handle shown in FIG. 8.
Figure 10:
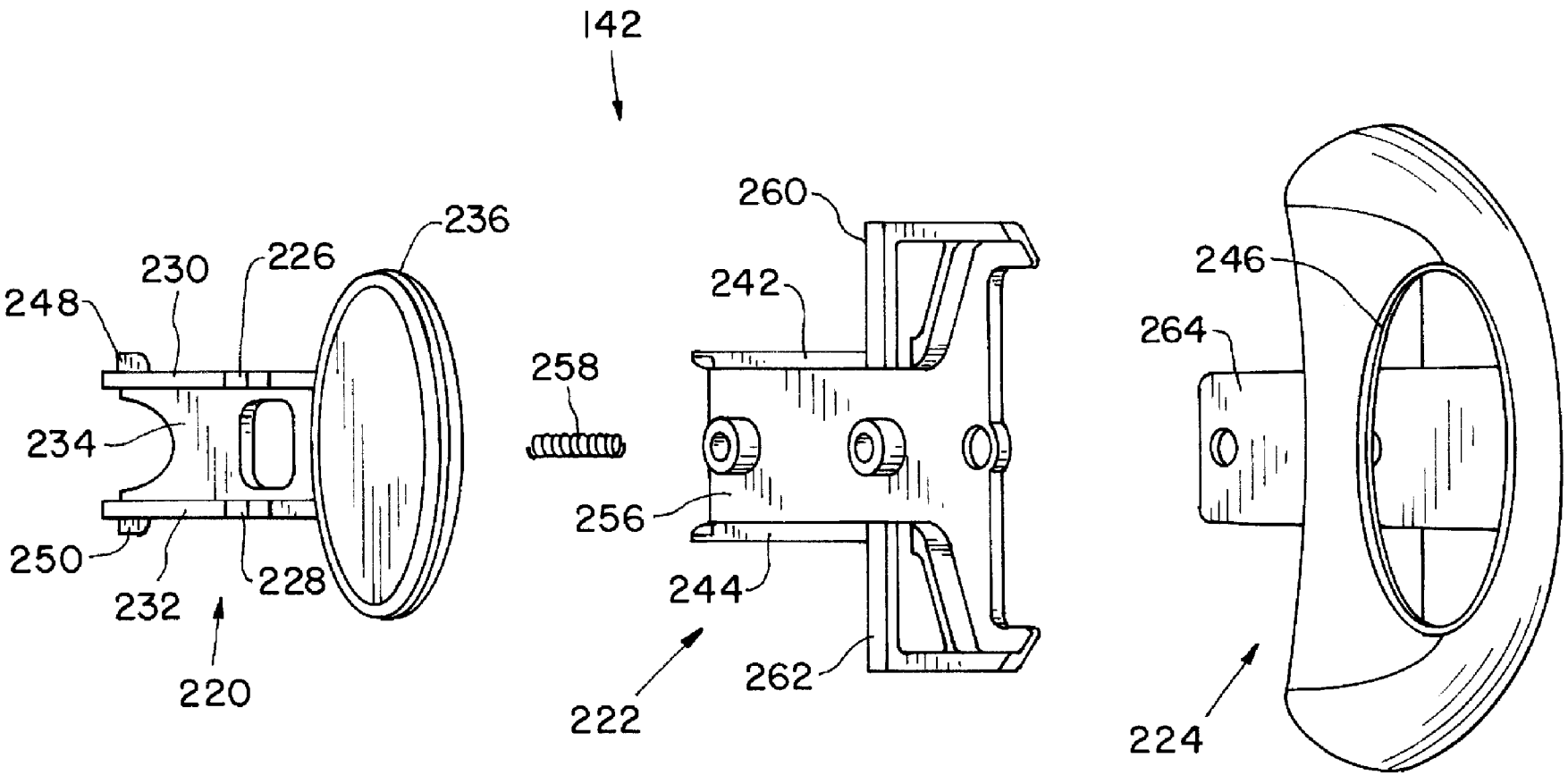
FIG. 10 is a top exploded view of the handle release mechanism shown in FIGS. 8 and 9, but shown from slightly different angle.

An assembled handle assembly 142 to selectively lock against and release cord 140 extending there through is shown in FIG. 8, and exploded views of handle assembly 142 are shown in FIGS. 9 and 10. Handle assembly 142 includes a trigger component 220, a lock body 222 and a trigger shell 224 assembled one to another and installed in vertical rails 104, 106. Trigger component 220 has open-ended slots 226, 228 in opposed rails 230, 232, respectively, along opposite edges of a base 234. A trigger button 236 is provided at one end of base 234. Lock body 222 has elongated openings 238, 240 in opposed rails 242, 244. Elongated openings 238, 240 have closed ends in rails 242, 244 near distal edges of the rails. Cord 140 is routed through slots 226, 228 and elongated openings 238, 240. In the assembled condition of handle assembly 142, rails 230, 232 are disposed between and adjacent rails 242, 244; and button 236 is exposed through an aperture 246 in trigger shell 224. Pins 248, 250 projecting outwardly from rails 230, 232, respectively, are received in holes 252, 254 of rails 242, 244, with base 234 of trigger component 220 overlying a base 256 of lock body 222. A spring 258 installed between base 234 and base 256 biases trigger component 220 toward a position in which base 234 is at an angle to base 256 such slots 226, 228 are not completely aligned or registered with elongated openings 238, 240. The closed inner ends of slots 226, 228 are urged tightly against the portion of cord 140 extended through handle assembly 142, thereby pinching the cord against outer limits of closed ended elongated openings 238, 240 in lock body 222. Biasing means other than a spring also can be used, and installed differently than as described Side extensions 260, 262 of lock body 222 extend into and engage trigger shell 224, and a base 264 of trigger shell 222 underlies base 256 of lock body 222 in the assembled handle assembly 142.

To release the cord and adjust the position of a vertical rail 104 or 106, button 236 of the selected vertical rail is depressed to overcome the biasing force of spring 258. Trigger component 220 pivots about an axis defined by pins 248, 250 in holes 252, 254 to move rails 230, 232 and base 234 toward base 256. The movement improves the aligned registration of slots 226, 228 with elongated openings 238, 240, thereby enlarging the opening defined between adjacent slots 226, 228 and openings 238, 240 and releasing the grip against cord 140. Handle assembly 142 then can be slid along cord 140 without substantial interference. Cord guides 132, 184 align the cord with handle assembly 142 so that the cord is not pinched or unduly scraped by handle assembly 142 when release of the cord is initiated and the vertical rail is moved.

Trigger component 220, lock body 222 and trigger shell 224 can be injection molded plastic, with spring 252 made of metal. However, materials other than plastic can be used also for trigger component 220, lock body 222 and trigger shell 224; and spring 252 or another biasing element can be made of other materials as well. Handle assembly 142 allows fabrics of different types and sizes to be used consistently by securing the adjusted positions of the vertical rails and minimizing creep. Further, handle assembly 142 is an exemplary structure suitable for engaging cord 140. Other types of locks, catches and releases also can be used for selectively engaging and releasing the cord to minimize creep. The exemplary embodiment shown and described is one suitable structure that has been found to work well.

Figure 11:
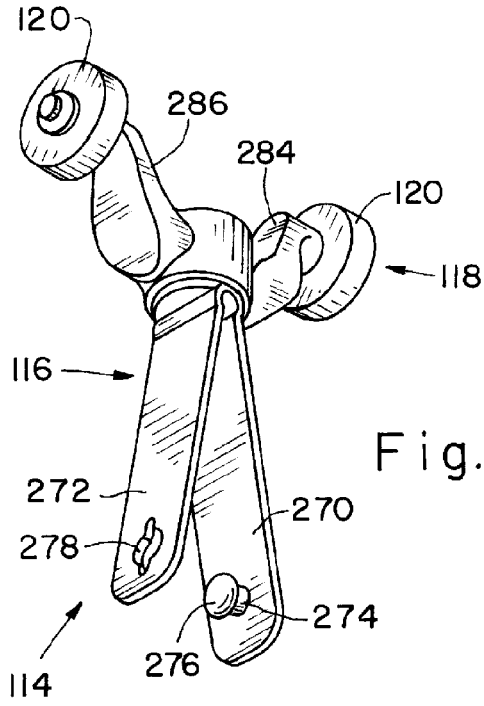
FIG. 11 is a perspective view of a fabric carriage for the vertical cellular blind shown in FIG. 1.
Figure 12:
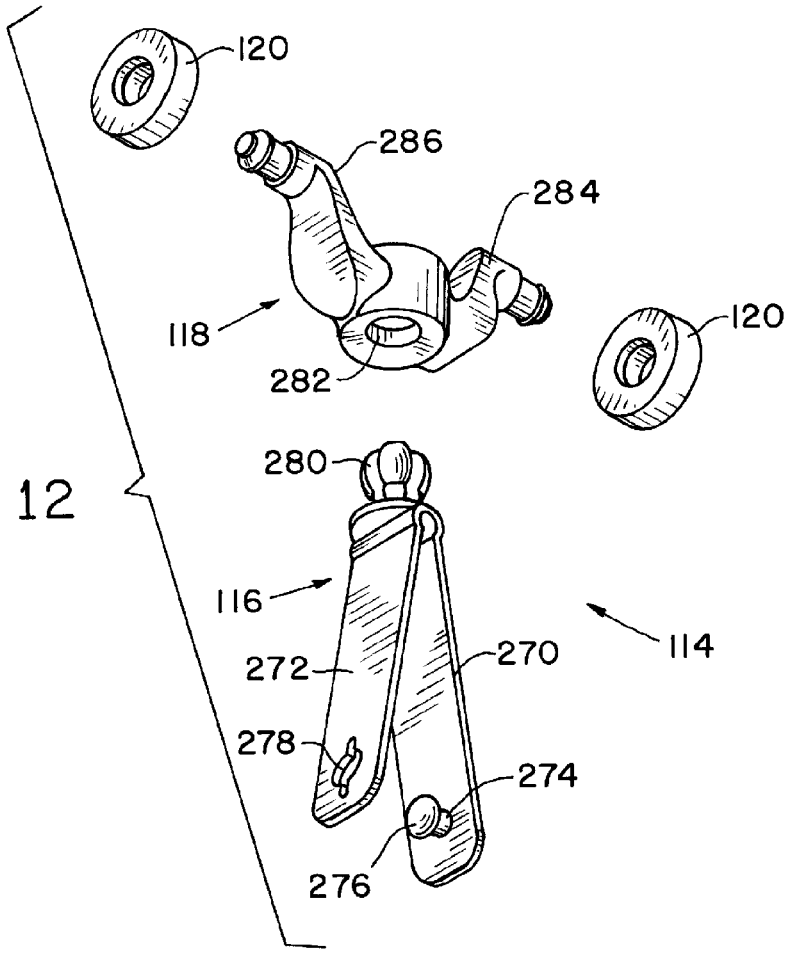
FIG. 12 is an exploded view of the fabric carriage shown in FIG. 11.

An assembled carriage assembly 114 is shown in FIG. 11, and an exploded view thereof is shown in FIG. 12. Fabric attachment stem 116 includes opposed arms 270, 272 that engage or connect one to the other to grasp the fabric held therein. In the exemplary embodiment shown in FIGS. 11 and 12, arm 270 is provided with a locking stud 274 having a bulbous or other enlarged end 276, and arm 272 is provided with an aperture 278 adapted to receive bulbous end 276 and a portion of stud 274 in locking engagement. A hole in fabric panel 102 can be slid over bulbous end 276 and placed on stud 274 before stud 274 is engaged with aperture 278. Interior surfaces of arms 270, 272 can be coated with a contact adhesive, or provided with adhesive strips to grasp the fabric held there between.

Fabric attachment stem 116 is held in trolley 118 by a snap-fit connection of complementary fixtures 280, 282 at an end of stem 116 and in trolley 118 respectively. In the exemplary embodiment, fixture 280 includes a plurality of deflectable prongs with enlarged ends, and fixture 282 is body defining a hole. Fixture 280 is pushed into fixture 282 and held therein by the complementary shapes and sizes of the fixtures, with the prongs of fixture 280 deflecting to allow installation and rebounding to provide a releasable engagement of fixture 280 in fixture 282. The snap-fit connection is provided for releasing the stem if the fabric panel is accidentally pulled or tugged. Fixture 280 is withdrawn from fixture 282 so that stem 116 disengages from trolley 118 to reduce the potential that fabric panel 102 is torn or otherwise damaged.

Trolley 118 is provided with lateral legs 284, 286 each holding a wheel 120 that is rotatable relative to the leg 284, 286 to which it is connected. Trolley 118 and stem 116 can be made of injection molded plastic.

An advantageous feature of the present invention is that complementary fixtures 280, 282 in stem 116 and trolley 118 are rotatable freely one with respect to the other, and thereby allow movement and twisting of the cellular material panel 102 relative to the fixed structure of headrail 108. With trolley 118 mounted in headrail 108 in a substantially non-rotatable position with respect to rotation about a vertical axis, stem 116 is freely rotatable relative to trolley 118. Further, stem 116 can remain in any rotated position relative to trolley 118. The less-hindered movement and adjustment enabled between panel 102 and headrail 108 by the free, unhindered relative axial rotation of stem 116 with respect to trolley 118 facilitates smooth flow and adjustment of the panel and promotes even, vertical suspension of the fabric panel so that pleats and folds in the fabric remain smooth, consistent and vertical.

Figure 13:
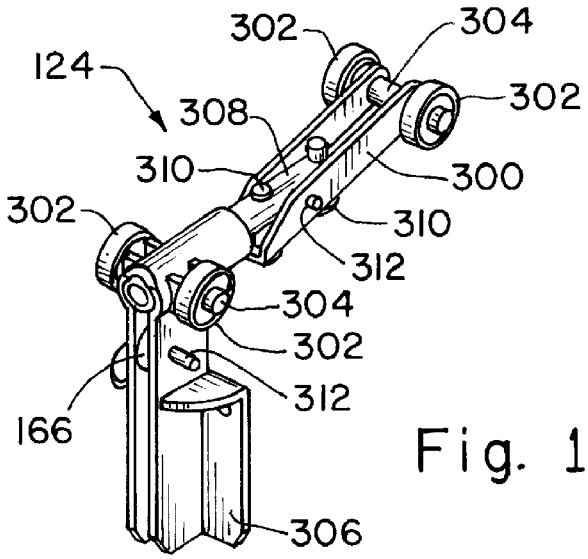
FIG. 13 is a perspective view of a vertical rail bracket for the blind shown in FIG. 1.
Figure 14:
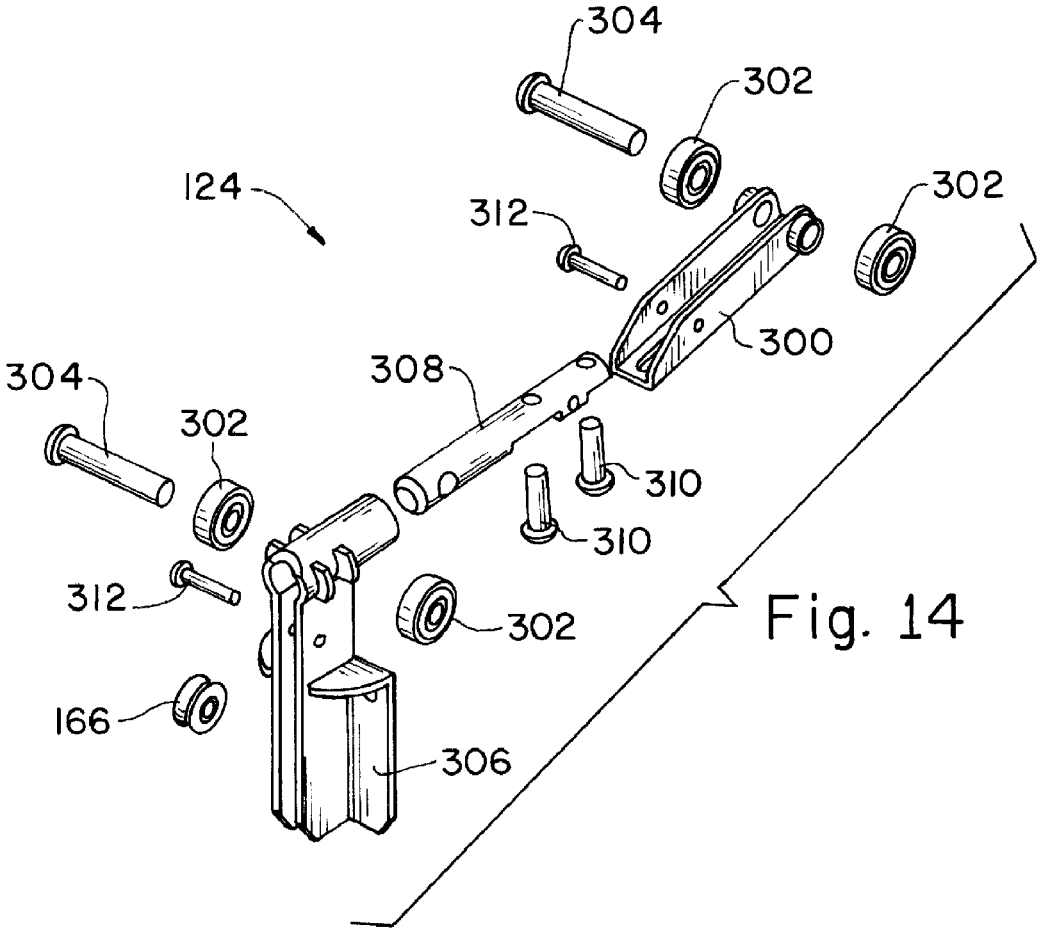
FIG. 14 is an exploded view of the vertical rail bracket shown in FIG. 13.

An assembled vertical rail bracket assembly 124 is shown in FIG. 13, and an exploded view thereof is shown in FIG. 14. Vertical rail bracket assembly 124 includes an angle bracket 300 having wheels 302 thereon, which may be bearings 302 acting as wheels disposed on a rivet or other shaft 304. A vertical rail bracket 306 directly engages and is connected to a vertical rail 104, 106. Rail bracket includes a rivet or other shaft 304 and wheels 302 similar to those of angle bracket 300. A rail pin 308 is connected to and between angle bracket 300 and vertical rail bracket 306. Threaded fasteners 310 extend through holes in angle bracket 300 and are received in threaded engagement in pin 308. Pin 308 is pivotally associated with bracket 300 by a rivet 312 engaging pin 308 at an axial position between fasteners 310.

The angular orientation of rail bracket assembly 124 is adjusted by changing the relative positions of fasteners 310 with respect to pin 308, and the lengths of fasteners 310 that extending outwardly of the pin. The angle formed in the assembly is changed as pin 308 pivots about rivet 312 when one of the fasteners 310 is withdrawn from pin 308 and the other fastener 310 is advanced more deeply into pin 308. In this way, the angle of vertical rail bracket 306 relative to angle bracket 300 is adjusted so that the vertical rail connected thereto hangs vertically from headrail 108, even under the springy influence of cellular fabric panel 102.

Roller 166 is rotatably held in vertical rail bracket 306 by a rivet 314. Vertical rail bracket assemblies 124 may be made of stamped steel or other metal, and the rivets fasteners and the like also made of steel or other metal. Plastic also can be used.

Figure 15:
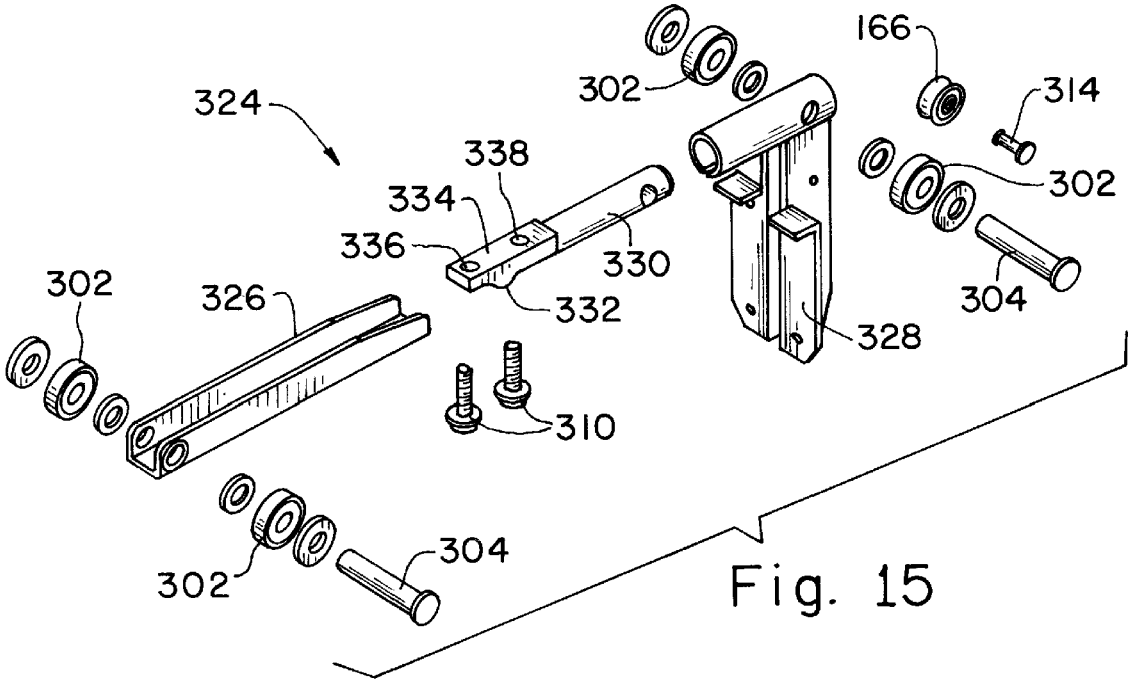
FIG. 15 is a perspective view of another embodiment for a vertical rail bracket.
Figure 16:
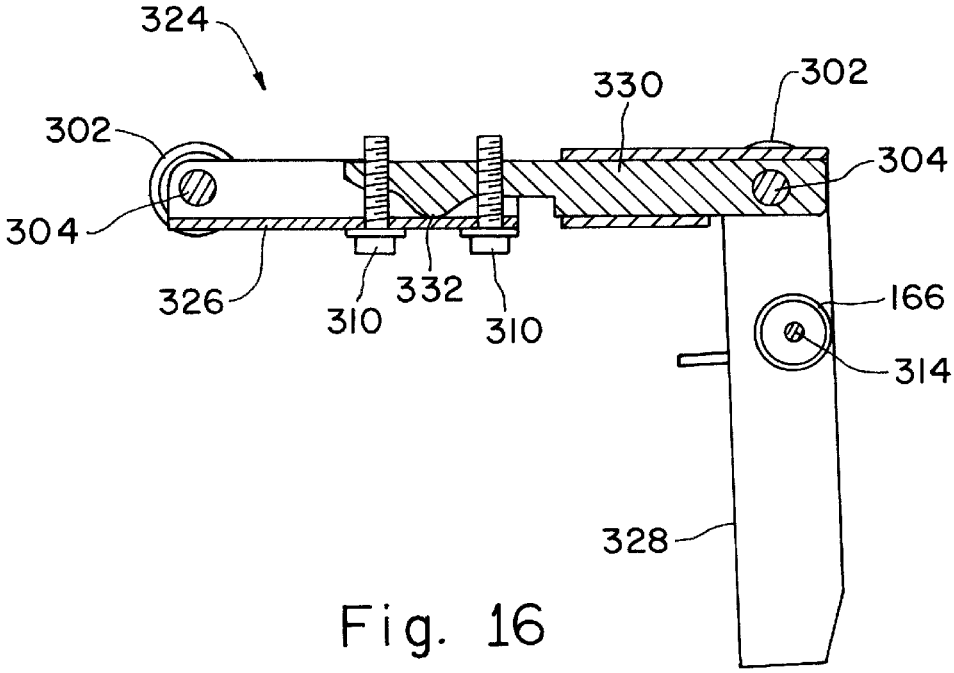
FIG. 16 is an exploded view of the vertical rail bracket shown in FIG. 15.

An exploded view of another embodiment of a vertical rail bracket assembly 324 is shown in FIG. 15, and a cross-sectional view thereof is shown in FIG. 16. Many of the components of vertical rail bracket assembly 324 are the same as corresponding components of vertical rail bracket assembly 124, and the same reference characters will be used to identify the correspondingly similar components. Vertical rail bracket assembly 324 includes an angle bracket 326 having wheels 302 thereon, which may be bearings 302 acting as wheels disposed on a rivet or other shaft 304. A vertical rail bracket 328 directly engages and is connected to a vertical rail 104, 106, and includes a rivet or shaft 304 and wheels 302 similar to those of angle bracket 326. A rail pin 330 connects angle bracket 326 to vertical rail bracket 328. Rail pin 330 defines a downwardly projecting transverse cam body 332 which may be formed in rail pin 330 or provided as part of an attached body 334 at an end of rail pin 330. Fasteners 310 extend through holes in rail bracket 326 and are received in threaded holes 336, 338 of pin 330 on opposite sides of cam body 332 relative to the axial extent of rail pin 330. Roller 166 is rotatable about rivet 314 held in vertical rail bracket 328. Vertical rail bracket assemblies 124 may be made of stamped steel or other metal, and the rivets fasteners and the like also made of steel or other metal. Plastic also can be used.

The angular orientation of vertical rail bracket assembly 324 is adjusted by changing the relative inserted depths of fasteners 310 with respect to pin 330. The angle formed in the assembly can be changed as angle bracket 326 moves against cam body 332 when one fastener 310 is advanced more deeply into the threaded hole 336, 338 receiving it and the other fastener 310 is withdrawn from the threaded hole 336, 338 receiving it. In this way, the angle of vertical rail bracket 328 relative to angle bracket 326 is adjusted so that the vertical rail connected thereto hangs vertically from headrail 108, even under the springy influence of cellular fabric panel 102.

Vertical rail bracket assemblies 124, 324 are of generally inverted "L" configurations as installed, with the generally horizontal components, including angle brackets 300, 326 and rail pins 308, 330, positioned substantially within and/or just below the upper track 126 in headrail 108. The horizontal components are directed inwardly from the generally vertical components, vertical rail brackets 306, 328 at the outer ends of rail pins 308, 330. Accordingly, carriages 114 in lower track 122 can slide beneath the horizontal components in the upper track, and folds of fabric panel 102 can gather beneath the horizontal components of rail bracket assemblies 124, 324. The panel can gather compactly and consistently to provide a consistent appearance from end to end, without interference from the vertical rail bracket assemblies.

Blinds of the present invention provide a decorating and cover solution for glass sliding doors and other large window applications. The blind can be provided in a variety of widths and lengths for both inside and outside mount applications. A variety of valance and cornice options can be used.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vertical cellular blind for an architectural opening, comprising:

a headrail having an upper track and a lower track, said upper track overlying said lower track;

a panel of cellular material suspended from carriages supported by and moveable in only said lower track;

a first vertical rail at an end of said panel, said first vertical rail being connected to said panel and being suspended from and movable along only said upper track;

a second vertical rail at an opposite end of said panel, said second vertical rail being connected to said opposite end of said panel and being suspended from only said upper track; and a cord extending through said fabric panel and into said first and second vertical rails and having segments extending out of said vertical rails and secured in said headrail.

2. The vertical cellular blind of claim 1, said second vertical rail being movable along said upper track.

3. The vertical cellular blind of claim 1, said vertical rails being suspended from moveable brackets in said headrail, each said bracket having an elongated horizontal headrail component disposed in said upper track and a generally vertical component connected to one of said first vertical rail and said second vertical rail, said horizontal headrail component extending from said vertical component above a top edge of said panel, and at least one said carriage slidable under said horizontal headrail component.

4. The vertical cellular blind of claim 1, said first vertical rail having a locking mechanism for selectively engaging and disengaging said cord and restricting and unrestricting relative movement between said vertical rail and said cord.

* * * * *